US008757083B2

(12) United States Patent
Kalwa

(10) Patent No.: US 8,757,083 B2
(45) Date of Patent: Jun. 24, 2014

(54) COUPLING HEAD, COUPLING DEVICE WITH COUPLING HEAD, RENDEZVOUS HEAD COUPLABLE THERETO, RENDEZVOUS DEVICE WITH RENDEZVOUS HEAD AND UNDERWATER VEHICLE THEREWITH, COUPLING SYSTEM, COUPLING METHOD AND DEPLOYMENT METHOD FOR AN UNDERWATER VEHICLE

(75) Inventor: Jörg Kalwa, Weyhe (DE)

(73) Assignee: Altas Elektronik GmbH, Bremen (DE)

( * ) Notice: Subject to any disclaimer, the term of this patent is extended or adjusted under 35 U.S.C. 154(b) by 208 days.

(21) Appl. No.: 13/340,222

(22) Filed: Dec. 29, 2011

(65) Prior Publication Data

US 2012/0167814 A1 Jul. 5, 2012

(30) Foreign Application Priority Data

Dec. 29, 2010 (DE) ..... 10 2010 056 539

(51) Int. Cl.
*B63G 8/00* (2006.01)

(52) U.S. Cl.
USPC ..... 114/312; 114/328

(58) Field of Classification Search
USPC ..... 114/312, 328
IPC ..... B63G 8/001,8/41
See application file for complete search history.

(56) References Cited

U.S. PATENT DOCUMENTS

| | | | | |
|---|---|---|---|---|
| 6,223,675 | B1 * | 5/2001 | Watt et al. | 114/312 |
| 7,535,706 | B2 * | 5/2009 | Herberholt et al. | 361/679.41 |
| 7,798,086 | B2 | 9/2010 | Ruggaber | |
| 2007/0261629 | A1 * | 11/2007 | Choi | 114/312 |
| 2010/0192831 | A1 | 8/2010 | Fournier | |

FOREIGN PATENT DOCUMENTS

| | | | |
|---|---|---|---|
| DE | 600 17 344 | T2 | 6/2005 |
| DE | 10 2007 031 156 | B4 | 4/2009 |
| JP | H07-223589 | A | 8/1995 |
| JP | 2003-26090 | A | 1/2003 |
| WO | 01/21476 | A1 | 3/2001 |

OTHER PUBLICATIONS

German Office Action dated Nov. 6, 2013, issued against German Patent Application 10 201 056 539.3.

* cited by examiner

*Primary Examiner* — Stephen Avila
(74) *Attorney, Agent, or Firm* — Fitch, Even, Tabin & Flannery LLP

(57) ABSTRACT

A coupling head 8, coupled to an autonomous underwater vehicle 4 via a rendezvous head 18 that is connectable to or part of the underwater vehicle 4. The coupling head 8 has an alignment stabilizing arrangement 12 for stabilizing its alignment and position in the water below the water surface. The invention further relates to a coupling device 2 having the coupling head 8 and having a cable 10 which is detachably connectable, mechanically, electrically and in a signal-connecting manner, to the coupling head 8, and to a rendezvous device 16 having the rendezvous head 18. The underwater vehicle 4 has the rendezvous head 18 and/or the rendezvous device 16, and a coupling system 1, which comprises at least the coupling and rendezvous heads. The invention further relates to a coupling method 58 and a deployment method 56 of an autonomous underwater vehicle 4 which includes the coupling method 58.

16 Claims, 3 Drawing Sheets

COUPLING HEAD, COUPLING DEVICE WITH COUPLING HEAD, RENDEZVOUS HEAD COUPLABLE THERETO, RENDEZVOUS DEVICE WITH RENDEZVOUS HEAD AND UNDERWATER VEHICLE THEREWITH, COUPLING SYSTEM, COUPLING METHOD AND DEPLOYMENT METHOD FOR AN UNDERWATER VEHICLE

CROSS-REFERENCE TO RELATED APPLICATION

The present application claims the priority of German patent Application No. 10 2010 056 539.3, filed Dec. 29, 2010, the subject matter of which, in its entirety, is incorporated herein by reference.

BACKGROUND OF THE INVENTION

The invention relates to a coupling head, to which an autonomous underwater vehicle can be coupled by means of a rendezvous head. The rendezvous head is fixed to the underwater vehicle or is part of the underwater vehicle. The coupling head is fixed, for example, to one end of a cable on the water side which is implemented as a recovery cable. Salvage cables are traditionally attached to a support vessel at their other end. This support vessel typically has a recovery winch arranged on it, from which the recovery cable is rolled off and onto which the recovery cable can be rolled up again.

The invention further relates to a coupling device which comprises the coupling head and a cable. The invention further relates to the rendezvous head for an autonomous underwater vehicle. In addition, the invention relates to a rendezvous device with this rendezvous head. In addition the invention relates to an underwater vehicle having the rendezvous head and/or having the rendezvous device. The invention further relates to a coupling system having both the coupling head and the rendezvous head. Furthermore, the invention relates to a coupling method for coupling together a coupling head with a rendezvous head and to a deployment method for an autonomous underwater vehicle with the coupling method.

An autonomous underwater vehicle (AUV) should be able to act autonomously in the water of a stretch of water, such as a sea or inland waterway, and therefore, while it is carrying out a mission in the water, typically has no cable connection to a support vessel. It is therefore difficult to recover after completion of the mission. Normally, after carrying out a mission the underwater vehicle is allowed to float up to the surface of the water. To recover it, the recovery cable with the hook is lowered into the area of the water surface and manually fastened, for example by the crew of a small boat launched from the support vessel for the purpose, to the underwater vehicle. Only then can the underwater vehicle be pulled up to the support vessel using the recovery winch and hoisted on board.

This known method for recovering an underwater vehicle is dangerous and also highly weather-dependent. In particular in heavy seas and under poor visibility conditions such as in fog, the recovery of an underwater vehicle by this known method is a dangerous maneuver both for the crew of the boat who fasten the recovery cable to the underwater vehicle, and for the underwater vehicle, which during this recovery maneuver could collide with this boat or even with the support vessel and thus be damaged.

Furthermore, it is known to discharge a line from the underwater vehicle, and to capture this line by means of a throw rope anchor, in order to recover the underwater vehicle by means of the captured line. Capturing the anchor line by means of the throw rope anchor however is strongly dependent on the skill of the crew throwing the anchor. In addition, the throw rope anchor can damage the underwater vehicle.

The recovery of the underwater vehicle by the methods described is also time-consuming. For one thing, it takes a certain amount of time to "capture" the underwater vehicle manually and by means of the cable and recovery winch to lift it into a resting position on the deck of the support vessel and launch it again by means of the recovery cable for a new mission. Secondly, on board the support vessel the underwater vehicle batteries must be regularly replaced or recharged. In addition, in the resting position measurement data from the previous mission, which are stored in the underwater vehicle, must be uploaded to the storage devices on the support vessel. Conversely, on board the support vessel the underwater vehicle is supplied with new mission data for the forthcoming mission. Overall therefore, a long time elapses between two missions, in which the underwater vehicle cannot be used for a mission.

The problem addressed by the invention is to improve the recovery and/or supply of an autonomous underwater vehicle.

SUMMARY OF THE INVENTION

The invention solves this problem by automating the coupling procedure and moving it to a region below the surface of the water. Preferably the coupling procedure takes place at a water depth between 10 and 20 meters below the surface of the water. This is because at this water depth, in contrast to the water in the region of the water surface, the water is comparatively calm. In particular, effects of the motion of the sea at this depth are negligibly small.

The coupling head according to the invention has position stabilizing means for stabilizing its alignment and position in the water, in particular at the water depth of 10 to 20 meters, below the water surface. Under a stabilized alignment of the coupling head is to be understood that essentially no rotations of the coupling head take place, or minor changes in rotational position can be corrected again. Under a stabilized alignment of the coupling head is to be understood that at least any movements of the coupling head in the horizontal plane essentially are uniform and any brief deviations from a fixed or uniformly moving alignment are corrected again.

The position stabilizing means hold the coupling head in the water in a stable enough manner such that it can be advantageously controlled by the underwater vehicle. In particular the position stabilizing means counteract any accelerations and tilting or rotational movements of the coupling head due to the surrounding water. Advantageously, the effect of the position stabilizing means therefore is that the coupling head holds an absolute position in the water or at least moves essentially uniformly along a trajectory which is preferably a straight line, but alternatively can also be curved. The position of the coupling head is in the present context to be understood as being its alignment, supplemented by height or depth information.

The alignment stabilizing means in a particular embodiment counteract both a rising and sinking of the coupling head in the water, and therefore act as position stabilizing means. In particular, the position stabilizing means ensure that the coupling head essentially maintains its depth in the water or its distance from the water surface. In this way the underwater vehicle can steer towards a rendezvous position, in particular underneath the coupling head, and be subsequently coupled to the coupling head particularly well from below. For coupling, the coupling head can change its position in the water while maintaining its stabilized alignment and position, namely to descend to the underwater vehicle.

The rendezvous head according to the invention is or can be coupled to the coupling head according to the invention. The coupling head and the rendezvous head therefore interact in the same way as, for example, a plug and a socket. The rendezvous head in particular is designed in such a way that an automatic coupling of the coupling head to the rendezvous head and preferably also an automatic decoupling of the coupling head from the rendezvous head is possible in the water below the water surface, in particular at a depth of between 10 and 20 meters below the water surface.

In the coupling method according to the invention for coupling together a coupling head with a rendezvous head therefore, the coupling head is stabilized in the water below the water surface in its orientation and position and coupled to the rendezvous head. The coupling head is from now on to be understood as being stabilized in its alignment and position, when it is accelerated towards the rendezvous head or lowered down to the rendezvous head and/or when it is intentionally actively aligned and positioned above the rendezvous head or above a target position controlled by the rendezvous head.

The position stabilizing means of the coupling head preferably comprises a controllable drive unit for actively aligning and positioning the coupling head in the water. Under alignment of the coupling head is to be understood in the present context that angles of tilt or rotation of the coupling head are adjusted. In particular, the longitudinal, transverse and lateral inclination of the coupling head in the water are adjusted. Preferably, the coupling head can be aligned and positioned by means of the controllable drive unit such that, in order to couple together, the coupling head and the rendezvous head move towards each other in an essentially vertical and/or horizontal direction.

Under the positioning of the coupling head in the water is to be understood in the present context that a position of the coupling head in the water is adjusted. This position can be an absolute position, wherein for example a length and a breadth can be specified with absolute coordinates, and a depth specified relative to the seabed or the water surface. Alternatively, the position of the coupling head is specified relative to a reference position moving along a trajectory. The reference position can be defined for example by a support vessel or an underwater vehicle, especially a submarine, which drags the coupling head behind it by means of a cable or recovery cable.

The drive unit for the position stabilizing means is preferably implemented by multiple propellers which preferably have rotational axes in multiple different directions and/or adjustable rotational axes, in order to facilitate an advantageous maneuverability of the coupling head. Alternatively or additionally the drive unit drives rudders, such as pitch elevators or ailerons, which facilitate an alignment and positioning of the coupling head in the water in particular when this coupling head is being towed through the water or is otherwise moving relative to the surrounding water. Alternatively or additionally, the drive unit comprises other means which facilitate an alignment and positioning of the coupling head relative to the water surrounding the coupling head.

The drive is controllable and facilitates the active alignment and positioning of the coupling head. To control the drive therefore, on the coupling head or at another place from which control signals or control commands can be sent to the coupling head, a control device is provided for controlling the active alignment and positioning of the coupling head in the water.

Due to the controllable drive, the depth of the coupling head in the water can be advantageously maintained or a desired depth can be set. Furthermore, a transverse offset of the coupling head towards a direction of movement of the rendezvous head or of the underwater vehicle containing the rendezvous head can be compensated by means of the controllable drive. Finally, the controllable drive enables a lowering of the coupling head in the direction of the rendezvous head to couple them together.

According to an advantageous embodiment of the coupling method according to the invention therefore, at least one drive unit of the coupling head is controlled, wherein this drive unit actively aligns and positions the coupling head in the water, in particular relative to a fixed or uniformly moving position.

The coupling head and the rendezvous head together preferably have a coupling mechanism by means of which the coupling head and the rendezvous head can be mechanically coupled to each other. This coupling mechanism is preferably constructed in two parts, wherein the coupling head has a first part of the coupling mechanism and the rendezvous head a second part of the coupling mechanism.

The coupling mechanism preferably produces a force-fitting and/or a positive-fitting connection between the coupling head and the rendezvous head. To achieve the coupling therefore, according to the method the coupling head is coupled to the rendezvous head by means of the coupling mechanism by means of a force fit and/or positive fit. As part of this, the first and second parts of the coupling mechanism preferably engage with each other.

For decoupling, the coupling head is preferably decoupled from the rendezvous head by means of a release mechanism, wherein the release mechanism is advantageously integrated into the coupling mechanism. The release mechanism is preferably constructed in two parts. The coupling head has a first part of the release mechanism, whereas the rendezvous head has a second part of the release mechanism. By means of the release mechanism the coupling head and the rendezvous head can preferably also be decoupled from each other underwater. The release mechanism can preferably be activated both by the coupling head and from the rendezvous head. In particular, the underwater vehicle can autonomously activate the release mechanism, e.g. to begin a mission. Alternatively or additionally, the release mechanism can be activated by a signal-connecting or data-connecting device connected to the coupling head.

The coupling head preferably comprises an energy transmission interface that can be detachably connected to the rendezvous head. Over this energy transmission interface, the underwater vehicle can be supplied with electrical energy via the rendezvous head. The underwater vehicle's batteries can therefore be charged up as soon as the coupling head and the rendezvous head are coupled together. The underwater vehicle need not therefore be lifted out of the water to recharge the batteries, but can remain in the water and after a short period of time to charge the batteries can be ready to start a new mission relatively quickly.

Preferably, at the same time as the coupling is produced by means of the above mentioned coupling mechanism, the energy transmission interface is connected to the rendezvous head. In particular, the coupling mechanism produces the positive and/or force-fitting connection between the coupling head and the rendezvous head and at the same time establishes a conductive connection of the power transmission interface of the coupling head to the rendezvous head, or to a corresponding interface on the rendezvous head. The connection can be separated and can be released again, in particular by means of the above release mechanism.

Preferably, the energy transmission over the energy transmission interface is effected by galvanic means, i.e. via one or more galvanic contacts. The energy transmission takes place in a particular embodiment in a contactless manner, in particular by means of induction. The energy transmission interface in this case comprises inductively operating energy transmission means.

The coupling head, alternatively or advantageously in addition, preferably has a data transmission interface that can be detachably connected to the rendezvous head. According to the method, in particular when coupling together, the data transmission interface of the coupling head is detachably connected to the rendezvous head. By this method a data connection, which can also be a signal connection, is produced between the coupling head and rendezvous head. In this way, data, in particular measurement data, can be sent indirectly from the underwater vehicle to a signal-connecting or data-connecting device connected to the coupling head. Alternatively or additionally, data, in particular mission data for a new mission, can conversely be transmitted over the data transmission interface of the coupling head to the rendezvous head and then on to the underwater vehicle. To do so the underwater vehicle can remain in the water each time, so that rest times or downtimes are reduced and the underwater vehicle can be ready to start a new mission relatively quickly.

Preferably, the data transmission over the energy transmission interface is effected by galvanic means, i.e. via one or more galvanic contacts. In a particular embodiment, however, the data transmission takes place in a contactless manner, in particular via radio or light waves. The data transmission interface in this case has electromagnetic and/or optical data transmission means, e.g. electromagnetic transmitter/receivers and/or optocouplers.

The rendezvous device according to the invention comprises the rendezvous head according to the invention. Advantageously, the rendezvous device additionally has an underwater modem with a receiving device for signals or data sent by the coupling head which can be used as a positioning aid. For example, by means of the underwater modem, an absolute or relative position of the coupling head relative to a fixed or moving reference position or relative to a position of the rendezvous head or of the underwater vehicle is received with the rendezvous head. Alternatively or additionally, detected changes in the position of the coupling head or a distance of the coupling head, e.g. from the rendezvous head, or an alignment of the coupling head, are transmitted by the coupling head and received by the underwater modem.

In one embodiment of the coupling method according to the invention the coupling head therefore communicates with the rendezvous device by means of a communication device of the coupling head, wherein the coupling head transmits signals which the rendezvous device receives and uses them as a positioning aid of the rendezvous head relative to the coupling head and/or for calculating an approach trajectory for driving the underwater vehicle towards a rendezvous position. The rendezvous head approaches the rendezvous position by means of the underwater vehicle controlled by this signal.

During this approach the rendezvous position is preferably defined by the respective position of the coupling head. In particular, the rendezvous position is preferably a position which is defined at a specific distance below the aligned coupling head which is awaiting the approach of the rendezvous head. For example, the rendezvous position lies one meter below the coupling head. In contrast, when the rendezvous device has reached the rendezvous position, the rendezvous position is from then on defined by the position of the rendezvous head, wherein the coupling head also approaches the rendezvous position and thus can subsequently couple onto the rendezvous head.

The rendezvous device preferably comprises a calculating device for calculating the direction and/or distance of the rendezvous head from the coupling head. Alternatively or additionally, the rendezvous device has a calculating device for calculating the rendezvous position defined by the position of the coupling head.

The communication between the coupling head and the rendezvous device enables the coupling head and the rendezvous head advantageously to approach each other sufficiently closely that an automatic coupling, in particular by means of an automatic or remote-controllable snap-locking snap-in catch, is subsequently possible.

For this purpose, the coupling head according to the invention preferably has the aforementioned communication device for sending signals, which is in particular an acoustic, optical or electromagnetic communications device. For example, acoustic signals, optical signals or electromagnetic signals, or data in such types of signals, are used as a positioning aid, in particular to calculate an approach trajectory by means of the communication device of the coupling head for guiding the approach of the rendezvous head towards the coupling head.

The rendezvous device preferably has a control device. The control device is configured such that, by means of this control device, depending on the direction and/or distance of the rendezvous head to the coupling head an approach trajectory is calculated for driving the underwater vehicle towards the rendezvous position. In addition, preferably by means of this control device, the underwater vehicle can be steered along this approach trajectory to this rendezvous position.

The coupling head preferably has position detection means. These position detection means are in particular sensors, preferably cameras or a camera and/or optical sensors. Alternatively, just one sensor can be present as a position detection means. By means of the position detection means, the relative position of the rendezvous head relative to the coupling head can be detected. In one embodiment the detected relative position is transmitted to the rendezvous device via acoustic and/or optical and/or electromagnetic signals.

Alternatively or additionally, the coupling head has position correction means, by means of which the alignment or position of the coupling head in the water relative to the detected relative alignment or position of the rendezvous head can be corrected. It can be the case, for example, that the rendezvous head, or the underwater vehicle having the rendezvous head, deviates laterally from the intended alignment on its route to the rendezvous position or after reaching the rendezvous position drifts away to the side. This is because underwater vehicles, in particular when travelling slowly or not moving at all, can often be moved sideways, albeit within narrow limits, or make a lateral correction to their position. It is advantageous therefore if the coupling head detects such a sideways drift and adapts its relative position to the rendezvous head in response to it, in particular by means of a positional correction transverse to the direction of motion of the rendezvous head.

In the coupling method according to the invention therefore, using the position detection means of the coupling head the coupling head advantageously detects the alignment or position of the rendezvous head and/or of the underwater vehicle relative to the coupling head. In addition, the coupling head advantageously detects any possible transverse displacement of the rendezvous head from this alignment or position relative to the approach trajectory of the rendezvous head, or of the underwater vehicle comprising the rendezvous head. This approach trajectory is preferably an approach trajectory calculated in advance, or an approach trajectory which the rendezvous head or the underwater vehicle having the rendezvous head has followed up to a previous point in time.

If a transverse displacement is detected, the coupling head corrects, preferably by means of the position correction means, the alignment or position of the coupling head in the water in accordance with a detected alignment or position and/or with a detected transverse displacement of the rendezvous head and/or of the underwater vehicle relative to each other. In doing so the position correction means rely in particular on the drive unit, wherein they effect an active correction of the position of the coupling head.

The rendezvous device preferably comprises an imaging system, such as a camera system and/or a sonar system, by means of which the alignment or position of the coupling head relative to the rendezvous head in a region close to the coupling head is optically sensed and can be transmitted to the control device. The region close to the coupling head is preferably a region of up to approximately 10 meters away from the coupling head. All parts of the rendezvous device, hence also the imaging system, in particular the camera system, are arranged either on the coupling head or on the underwater vehicle. In particular when the rendezvous head or the underwater vehicle, and thus also the imaging system, in particular the camera system, is located in this region close to the coupling head, the system can advantageously be switched into a precision mode and the coupling head or the rendezvous position can be driven under optical guidance.

In an advantageous embodiment the coupling head is supplied with electrical energy via a supply line of a cable, in particular a recovery cable, which is permanently or detachably mechanically connected to the coupling head. Alternatively or additionally, signals or data can be transferred to and/or from the coupling head via a data line of the cable. In particular for supplying the rendezvous head or the underwater vehicle connected to the rendezvous head respectively, electrical energy can therefore be supplied via the coupled coupling head to the underwater vehicle by means of the supply line and a data exchange can take place through the supply line to and/or from the underwater vehicle. Alternatively or additionally, the coupling head is recovered and/or launched into the water by means of the cable, wherein the cable is designed to withstand the necessary tensional loads.

The invention further relates to a coupling device with the coupling head according to the invention and with the cable which is mechanically connected or detachably connectable to the coupling head. In addition, the invention relates to an underwater vehicle having the rendezvous head according to the invention and/or having the rendezvous device according to the invention.

The invention relates additionally to a coupling system having the coupling head according to the invention and/or having the coupling device according to the invention as well as having the rendezvous head according to the invention and/or having the rendezvous device according to the invention and/or having the underwater vehicle according to the invention. In each case the coupling system comprises a coupling head and a rendezvous head, which can be and/or are coupled to each other reversibly.

Finally, the invention relates to a method for deploying an autonomous underwater vehicle, wherein the deployment method includes the coupling method according to the invention. According to the deployment method according to the invention, the underwater vehicle has first carried out a mission. After completing the mission the underwater vehicle travels to the rendezvous position. This rendezvous position can be a position which is previously stored in the underwater vehicle or alternatively received by the underwater vehicle during the mission or after completion of the mission.

The underwater vehicle preferably subsequently holds its, in particular fixed or uniformly moving position, wherein the coupling head maneuvers by means of its drive, optically and/or acoustically guided, to the rendezvous head in such a manner that the coupling head is mechanically coupled to the rendezvous head with a force fit and/or positive fit.

The deployment method can be a supply method and/or a recovery method. When the deployment method is a supply method, to supply the underwater vehicle an electrical connection is produced, via which the underwater vehicle is supplied with electrical energy via the coupling head. Alternatively or additionally a data connection is produced via which measurement data from the underwater vehicle are provided via the coupling head. Alternatively or additionally, mission data for a new mission are transferred via the coupling head to the underwater vehicle.

When the deployment method alternatively or additionally is a recovery method, the underwater vehicle is pulled and/or lifted into a resting position for recovering this underwater vehicle by means of the coupling device. The resting position can be a position on deck or in a container on board a support vessel, which preferably has a recovery winch, onto which the cable, in this case implemented as a recovery cable, can be rolled and so that the underwater vehicle can be lifted out of the water.

The resting position can also be e.g. a stationary garage installed on the hull of a submarine or on the sea bed. For example, the invention can be used for checking the foundations of offshore wind turbines. In this case a garage can be installed on the foundation of a wind turbine. The cable is in this case fixedly connected to the garage or to a station installed on the wind turbine.

The approach to the rendezvous position preferably includes the coupling head maintaining a fixed, hydrodynamically favorable position, wherein the coupling head and the rendezvous head determine relative positions and alignments or orientations of the rendezvous head and/or of the underwater vehicle and the coupling head relative to each other. Preferably, an approach trajectory to the rendezvous position, defined relative to the position and orientation of the coupling head, is subsequently calculated from the relative positions and orientations. The underwater vehicle preferably travels automatically or autonomously along the approach trajectory to the rendezvous position.

In an advantageous embodiment, on reaching a defined distance of the rendezvous device and/or the underwater vehicle relative to the rendezvous position, the system is changed into a precision mode, in which the underwater vehicle, taking account of any current and applying available sensor information, is maneuvered into the rendezvous position. This sensor information can be e.g. the information determined by means of the above mentioned camera.

Further embodiments result from the claims and from the exemplary embodiments to be explained with the aid of the drawing.

DETAILED DESCRIPTION OF THE INVENTION

Figure 1:
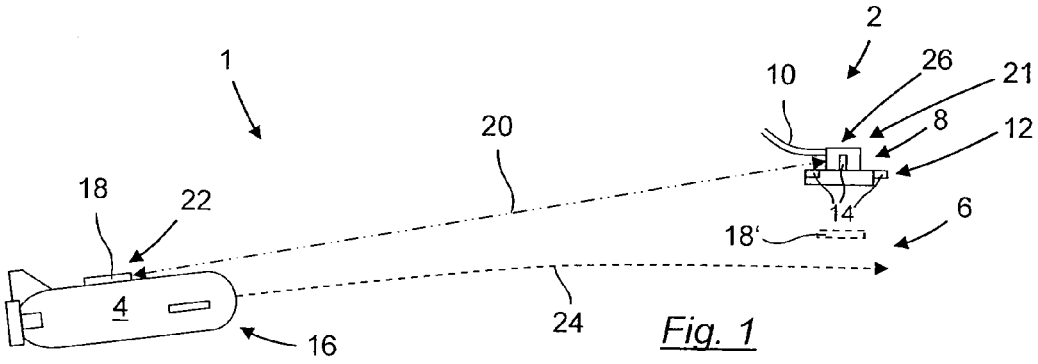
FIG. 1 illustrates a coupling system having a coupling device comprising a coupling head and having an underwater vehicle with a rendezvous device comprising a rendezvous head, and parts of a coupling method which is used in a deployment method for an underwater vehicle, according to a first exemplary embodiment.

FIG. 1 shows a coupling system 1 with a coupling device 2 together with an underwater vehicle 4 in a stretch of water below the water surface of this stretch of water. The underwater vehicle 4 is an autonomous underwater vehicle (AUV) which has carried out a mission in which it has collected measurement data during the mission, and is now travelling towards a rendezvous position 6, in which a coupling to a coupling head 8 of the coupling device 2 is planned.

The coupling device comprises, apart from the coupling head 8, a cable 10 fastened to this coupling head 8, which is implemented as a recovery cable. The other end of the cable 10, not shown, is fastened e.g. to a support vessel, not shown, from which the cable including the coupling head 8 is wound off by means of a recovery winch. Both the cable 10 and the coupling head 8 each have approximately a ratio of mass to volume that corresponds to the equivalent ratio for water. For this reason, the coupling head 8 and the cable 10 have at worst a slight tendency to slowly rise or sink in the water. Essentially the coupling head 8 remains at a depth of approx. 10 to 20 meters below the water surface in the water, to which it has been lowered according to FIG. 1. The mass distribution in the coupling head 8 is in this case such that the coupling head 8, due solely to this mass distribution which therefore acts as part of position stabilizing means 12, stabilizes against lateral tilting or against rolling motions in its alignment.

In addition, the coupling head 8 has other means as position stabilizing means 12, namely a plurality of controllable drive units 14. These drives 14 have propellers with horizontally and vertically aligned rotational axes, which force water substantially along these rotational axes by means of the respective propeller and can therefore effect a relative motion of the coupling head relative to the water surrounding them. Instead of the drives 14 with propellers, differently constructed drives can also be provided which can effect a change of alignment or position of the coupling head relative to the surrounding water.

By means of the drives 14, the coupling head can be actively aligned and positioned in the water so that it actively positions itself above the intended rendezvous position 6 and then maintains its position above the rendezvous position 6 until the underwater vehicle 4 has reached this rendezvous position.

The coupling system 1 has a rendezvous device 16 arranged on the underwater vehicle 4, having a rendezvous head 18 fixed onto the underwater vehicle 4. This rendezvous head 18 is detachably or fixedly connected to the underwater vehicle 4 or integrated into the underwater vehicle 4.

The rendezvous device 16 first steers the underwater vehicle 4, in particular for as long as no information about the actual current position of the coupling head is available, roughly in the direction of the rendezvous position 6 previously specified and stored in the rendezvous device 16. On approaching further, the rendezvous device 16 and the coupling head 8 exchange information over a communication channel 20, such as absolute or relative positions from each other, directions and/or speeds. For this purpose the coupling head 8 comprises an acoustic communication device 21, by means of which it sends acoustic signals over the communication channel 20 as a positioning aid for the underwater vehicle 4. The rendezvous device 16 receives these acoustic signals by means of hydrophones 22 arranged on the underwater vehicle 4 or on the rendezvous head 18 and using this information, calculates an approach trajectory 24 of the underwater vehicle 4 to the rendezvous position 6. The approach trajectory 24 then turns out to be such that in the rendezvous position 6, the rendezvous head 18 engages approximately 1 meter below the coupling head 8, indicated by the dashed rendezvous head 18'.

Conversely, the coupling head 8, in particular the communication device 21, also has hydrophones 26 for receiving waterborne sound signals which are transmitted over the communication channel 20 by the underwater vehicle 4 or by the rendezvous head 18. For example, current position data and data relating to the direction and orientation of the motion of the underwater vehicle and the calculated approach trajectory 24 are transferred over the communication channel 20 to the coupling head 8. To send the sound signals, both the underwater vehicle 4, or rendezvous head 18, as well as the coupling head 8 also have means for the generation and targeted emission of waterborne sound signals. These means on the coupling head 8 are part of the communication device 21.

Alternatively or additionally, the communication channel 20 is formed by sending and receiving optical and/or electromagnetic signals, where means for sending and receiving these optical or electromagnetic signals are accordingly provided, or the communication device 21 comprises these means.

Figure 2:
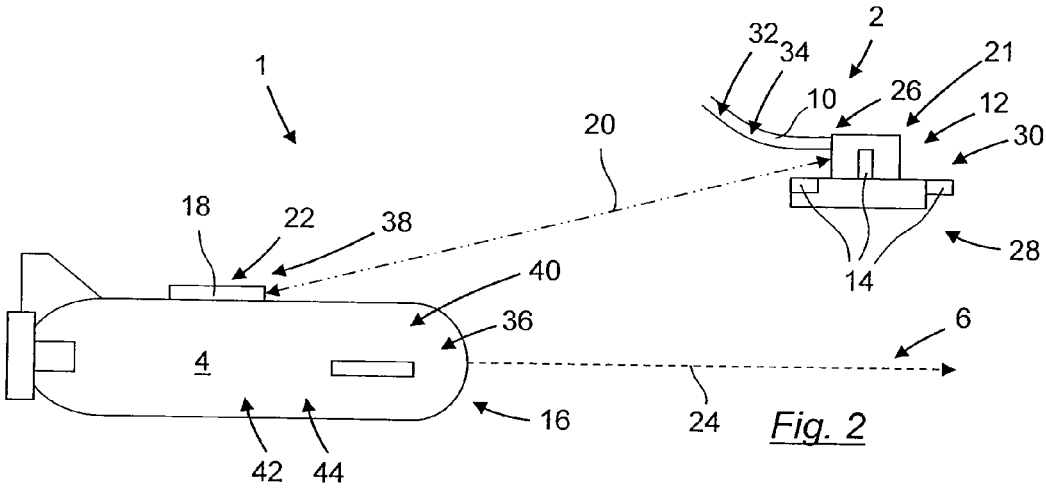
FIG. 2 to FIG. 4 illustrate the devices of the first exemplary embodiment according to FIG. 1 in other spatial positions and other temporal positions relative to FIG. 1 in the coupling method.
Figure 3:
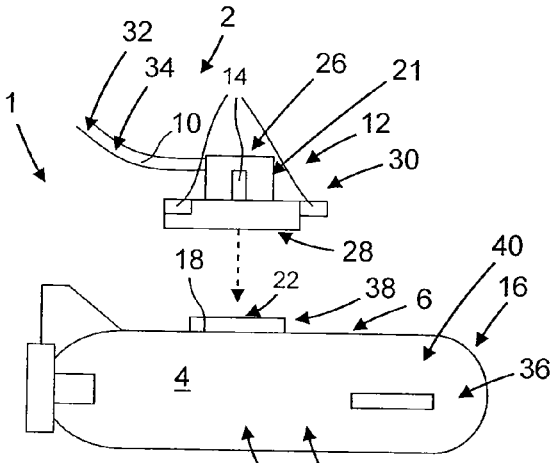
Figure 4:
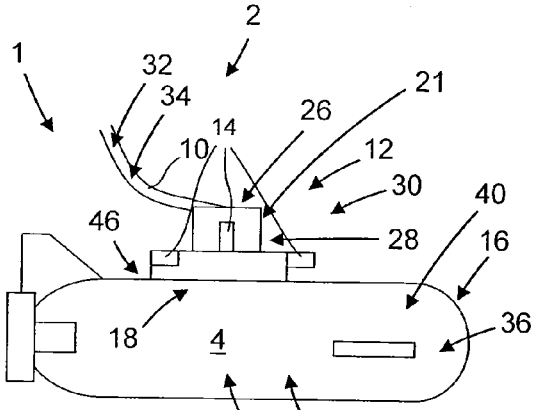

FIG. 2 shows, as do FIGS. 3 and 4 also, the coupling system 1 of the first exemplary embodiment of FIG. 1 in an arrangement of the underwater vehicle 4 relative to the coupling head 8 which differs only compared to FIG. 1. Identical reference marks thus refer to identical parts. In the illustration according to FIG. 2 the underwater vehicle 4 is located relative to the illustration of FIG. 1 at closer proximity relative to the coupling head 8. In particular, the distance of the underwater vehicle 4 relative to the coupling head 8 is less than 10 meters. The rendezvous device 16 is therefore changed into a precision mode, in which the underwater vehicle 4 is maneuvered into the rendezvous position 6, applying all available sensor information. In this mode any currents which are sensed by the sensors on the underwater vehicle 4 are taken into account, in particular compensated by means of appropriate countermeasures. The coupling head 8 continues to hold its alignment or position above the rendezvous position 6.

The coupling head 8 has a plurality of sensors as position detection means 28, by means of which it detects the relative alignment or position of the rendezvous head 18 or of the underwater vehicle 4 to the coupling head 8. These position detection means or sensors are e.g. cameras and/or optical sensors. The underwater vehicle 4 or the coupling head 8 therefore sends out an optical signal which can be received by the position detection means 28. Alternatively or additionally, the rendezvous head 18 has its own light source with which it illuminates the underwater vehicle 4 at least from a specific proximity, so that the position detection means 28 can receive light reflected by the underwater vehicle 4 or by the rendezvous head 18.

The coupling device comprises calculating means, decision-making means and control means for processing sensor information, for providing Information which is sent over the communication channel 20 to the coupling device 2, and for controlling the position stabilizing means 12 and for controlling position correction means 30. The drives 14 are in this case assigned both to the position correction means 30 and to the position stabilizing means 12. In particular, the drives 14 are used not only for stabilizing the position, but also for correcting the alignment or position of the coupling head 8 in the water. Alternatively however, separate position correction means from the position stabilizing means 12 can also be provided. The calculating means, decision-making means and control means of the coupling device 2 can be provided wholly or partially in the coupling head 8. These means can in addition also be wholly or partially arranged on board the above mentioned support vessel, not shown.

The coupling device 2 calculates or detects, based on its current actual position, direction of motion and speed and based on available flow conditions, whether the underwater vehicle 4 either cannot reach the rendezvous position or only reach it by making maneuvers defined as unacceptable for the purpose. If appropriate, this calculation is also carried out wholly or partially by the rendezvous device 16. Exchange of captured, pre-processed or analyzed data takes place via the communication channel 20.

If it detects that the underwater vehicle 4 cannot reach the rendezvous position 6 in an acceptable manner because, for example, the underwater vehicle 4 is driven laterally off alignment and lateral alignment corrections of the underwater vehicle, in particular when travelling comparatively slowly, are only possible with difficulty, then the position correction means 30 are instructed to change the alignment or position of the coupling head 8 and thereby define a new rendezvous position 6 underneath the coupling head 8, which can be achieved by the underwater vehicle 4 in a permissible way.

The power supply for all devices arranged on the coupling head 8, in particular for the position stabilizing means 12 and the position correction means 30 including the drives 14 and for the arranged sensors including the hydrophones 26 and the sensors for sending signals or the communication device 21, is supplied with electrical energy via the cable 10. This cable 10 therefore has an electrical conductor 32 for supplying energy to the coupling head 8 from the support vessel via the cable 10. The electrical conductor 32 is preferably a copper conductor or at least a conductor containing copper. In addition the cable 10 has at least one signal lead 34 or data lead, over which the control commands and sensor information or processed or pre-processed information can be transferred from the support vessel to the coupling head 8 and from the coupling head 8 to the support vessel. In particular when parts of the coupling device 2 are arranged on the support vessel, it is necessary to transmit information between the coupling head 8 and the support vessel. The signal lead 34 is preferably an optical fiber or fiber-optic cable, or comprises at least one optical fiber.

The cable 10 is detachably connected to the coupling head 8. In particular for maintenance purposes, the coupling head 8 can be removed from the water-side end of the cable 10 on board the support vessel. It can also be useful to remove the coupling head from the cable 10 in order to use the cable 10 for other purposes and on occasion to fit it with another end piece.

The rendezvous device 16 has an underwater modem 36 in the underwater vehicle 4 or in the rendezvous head 18. This underwater modem 36 has a receiving device 38 for the signals sent by the coupling head. The hydrophones 22 mentioned above can be part of the receiving device 38. The rendezvous device 16 additionally has a calculating device 40, by means of which the direction and/or the distance of the coupling head 8 relative to the rendezvous head 18 or to the underwater vehicle 4 is calculated from signals received via the communication channel 20 and/or other sensed signals or data. In addition the rendezvous device 16 has a control device 42, which in accordance with the direction and/or distance from the rendezvous head 18 to the coupling head 8 and in accordance with the received or calculated rendezvous position 6, maneuvers or steers the underwater vehicle 4 along this approach trajectory 24 to this rendezvous position 6. The calculation of the approach trajectory 24 can be performed by the control device 42 or also by the calculating device 40. Both the calculating device 40 and the control device 42 can be provided exclusively for the coupling method according to the invention or be part of systems on the underwater vehicle 4, which are additionally used for other calculating tasks or control tasks of the underwater vehicle 4.

The rendezvous device 16 comprises an imaging system implemented as a camera system 44, which is for example part of the rendezvous head 18. In the precision mode, this camera system 44 supports the exact maneuvering towards the rendezvous position 6 in the region of the underwater vehicle 4 relatively close to the coupling head 8, or at a distance of the underwater vehicle 4 relative to the coupling head 8 of less than 10 meters. The camera system 44 comprises at least one camera which acquires optical images of the coupling head 8. The coupling head 8 preferably has high-contrast significant patterns which are optically particularly well acquired by means of the camera system 44 and can be analyzed by means of the calculating device 40 or the control device 42. In particular the calculating device 40 or the control device 42 carries out an image analysis of the images acquired by means of the camera system 44 of the coupling head 8, with the aid of which, either alone or in support of other means, the position of the underwater vehicle 4 relative to the coupling head 8 is determined.

FIG. 3 shows the underwater vehicle 4 after reaching the rendezvous position 6. At this point of the coupling method the coupling head 8 holds its position or its position in the longitudinal and transverse directions relative to the underwater vehicle 4, whereas the distance from the coupling head 8 to the rendezvous head 18 is reduced by the coupling head 8 actively moving in the direction of the rendezvous head 18.

The camera system 44 additionally controls the position of the underwater vehicle 4 relative to the coupling head 8. Alternatively or additionally this position is determined acoustically or by means of electromagnetic signals. The coupling device 2 also determines, separately or together, in particular by exchanging signals over the communication channel 20 with the rendezvous device 16, the position of the underwater vehicle 4 or of the rendezvous head 18 relative to the coupling head 8. In the rendezvous position 6 the underwater vehicle 4 can either be motionless without being powered or move under power, in particular uniformly in a forwards direction, in order advantageously to actively maneuver and e.g. to counteract drifting due to currents. The coupling head 8, after the underwater vehicle 4 reaches the rendezvous position 6, follows the longitudinal position and the transverse position of the underwater vehicle 4, wherein the coupling head 8 reduces its vertical distance to the rendezvous head 18 and therefore actively sinks slowly onto the rendezvous head 18 to couple the coupling head 8 to this rendezvous head 18. At the same time the coupling head 8, by means of its drives 14, compensates in particular for any detected transverse offset of the coupling head 8 relative to the underwater vehicle 4 that may be present, in relation to the direction of travel of the underwater vehicle 4. While the underwater vehicle 4 can still counteract any drifting in the longitudinal direction by means of its own drives, any controllability of the underwater vehicle 4 in a transverse direction relative to its main direction of motion is comparatively limited. In particular the detected transverse displacement is therefore actively compensated for by the coupling head 8.

FIG. 4 shows the coupling head 8, coupled to the rendezvous head 18. The coupling in this case is produced by means of a two-part coupling mechanism 46, of which the first part is arranged on the coupling head 8 and the second part on the rendezvous head 18. The coupling by means of the coupling mechanism 46 thus takes place automatically, preferably purely mechanically, when the coupling head 8, starting from its position shown in FIG. 3 reaches its position shown in FIG. 4 relative to the rendezvous head 18. In particular, the coupling mechanism 46 has a snap-in catch, wherein e.g. a movable snap-in bracket of the snap-in catch in the first part of the coupling mechanism 46 engages behind a second part of the coupling mechanism 46 matched thereto, where it latches in place and thereby produces a positive-fitting connection of the coupling head 8 to the rendezvous head 18.

The coupling mechanism 46 is preferably implemented such that the coupling, in particular the positive-fitting connection, between the coupling head 8 and the rendezvous head 18 can be released again only by means of a release mechanism 48. By means of the release mechanism 48, e.g. an automatically engaged locking of the coupling mechanism during the coupling, in particular of the snap-in hook, can be released again. The release of the locking is effected e.g. electromagnetically or by an electric motor in response to control commands or electrical signals which are provided by the coupling device 2 or the rendezvous device 16.

The release mechanism 48, like the coupling mechanism 46, has a first part arranged on the coupling head 8 and a second part arranged on the rendezvous head 18. The in particular electrical release of the coupling by means of the release mechanism 48 is effected either on the first part, on the second part or on both parts of the release mechanism 48. Also, a part of the coupling mechanism 46, which e.g. can be simply a groove into which the aforementioned snap-in closure engages, is in this context still regarded as part of the release mechanism even if it does not contribute to the release by mechanical movement, but merely maintains the coupling until the release mechanism 48, for example, removes the positive-fitting connection.

The coupling head 8 has an energy transmission interface 50 and a data transmission interface 52. The energy transmission interface 50 automatically produces an electrical connection between the coupling head 8 and the rendezvous head 18, and therefore between the coupling device 2 and the rendezvous device 16 or underwater vehicle 4 respectively, when the coupling head 8 and the rendezvous head 18 are coupled together. Therefore, by means of the invention the underwater vehicle 4 situated underneath the water surface can be supplied with electrical energy by the support vessel via the cable 10, via the coupling head 8 with the energy transmission interface 50 and via the rendezvous head 18, so that e.g. batteries of the underwater vehicle 4 can be charged up. It is furthermore possible to supply drives of the underwater vehicle 4 directly via the cable 10 with electrical energy, in order to be able to continue to guide the underwater vehicle 4 below the water surface in a parked position in the event of bad weather, for example, which makes a recovery impossible, even if the batteries of the underwater vehicle 4 are exhausted.

The data transmission interface 52, in an analogous way, produces a signal connection or data connection between the coupling head 8 and the rendezvous head 18, when this coupling head 8 and the rendezvous head 18 couple together. By this means the underwater vehicle 4 can be supplied not only with electrical energy but also with new mission data for a forthcoming mission, without needing to be lifted out of the water. Conversely, measurement data stored in a memory of the underwater vehicle 4 can be read out and transferred to the support vessel via the data transmission interface 52 and the cable 10. The underwater vehicle 4 can consequently remain in the water between two missions. When the coupling between the coupling head 8 and the rendezvous head 18 is released again, in particular by means of the release mechanism 48, the energy transmission interface 50 and the data transmission interface 52 also automatically break their respective connection to the rendezvous head 18.

The end of the cable 10 opposite the coupling head 8 can alternatively also be fastened to a static station, to a submarine or to a helicopter. The static station can be arranged wholly or partially below the water surface. For example, in one exemplary embodiment a garage is provided on the foundation of a wind turbine, into which the underwater vehicle 4 is towed by means of the cable 10. There, measurement data from a previous mission are read out and if appropriate, new mission data transferred to the underwater vehicle. Subsequently the underwater vehicle leaves the garage either after decoupling from the coupling head or immediately, together with the coupling head, in order to start on a new mission. When the underwater vehicle has left the garage together with the coupling head 8, this coupling head 8 decouples from the rendezvous head 18 outside the garage and is advantageously towed back into the garage again by means of the cable 10, until a return of the underwater vehicle 4 is expected.

The underwater vehicle 4 subsequently autonomously examines e.g. the foundations of wind turbines of a wind farm by means of different sensors. In an extension, the underwater vehicle 4 can additionally comprise means by means of which it actively undertakes work on objects below the water surface, in particular repair work.

In particular when the underwater vehicle 4 is to be recovered by means of the cable 10, this cable 10 is designed to withstand tensile strain, so that the underwater vehicle 4 can also be towed by the cable 10 above the water surface and e.g. lifted upwards onto the deck of the above mentioned support vessel or up to the above mentioned helicopter.

Figure 5:
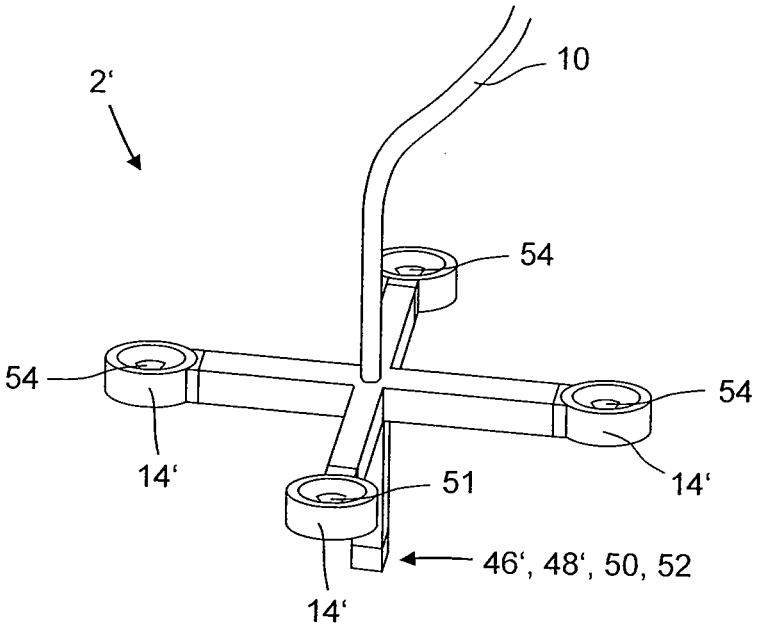
FIG. 5 shows a further coupling device with a coupling head constructed differently to the coupling head of FIGS. 1 to 4 according to a second exemplary embodiment.

FIG. 5 shows a coupling device 2' having a coupling head 8' according to a second exemplary embodiment of the invention. This exemplary embodiment illustrates that the coupling head 8 or 8' can be embodied in a variety of ways within the scope of the invention. The coupling head 8' has a cross-shaped section with drives 14' mounted at its ends. For the coupling procedure this cross is aligned horizontally in the water by means of the drives 14'. When the cross of the coupling head 8 is aligned horizontally in the water, one section of the coupling head 8' having a first part of a coupling mechanism 46', a first part of a release mechanism 48', the energy transmission interface 50 and the data transmission interface 52 points downwards in a vertical direction from the centre of the cross. In the opposing vertical direction the cable 10 is detachably mounted on the coupling head 8'.

The drives 14' can be pivoted about rotational axes, the imaginary extensions of which extend longwise in the arm of the cross of the coupling head 8' on which the respective drive 14' is mounted. By controlling the speeds with which propellers 54 of the drives 14' rotate, and by suitable pivoting of the drives 14' about the aforementioned rotational axes, the coupling head 8' can position itself autonomously in any desired alignment or position and orientation in the water. With the cross of the coupling head 8 horizontally aligned, sideways movements are easily possible by this method.

Alternatively however, individual drives 14' or all of them can be rigidly fixed to the cross of the coupling head 8'. Sideways movements of the coupling head 8 in the water are possible by this method, when by means of suitable speed control of the propellers 54 the coupling head 8' is temporarily tilted and the cross of the coupling head 8' is therefore temporarily tilted away from the horizontal.

Naturally, a variety of other configurations of the coupling head 8' with differently arranged and different numbers of drives are possible within the scope of the invention.

Figure 6:
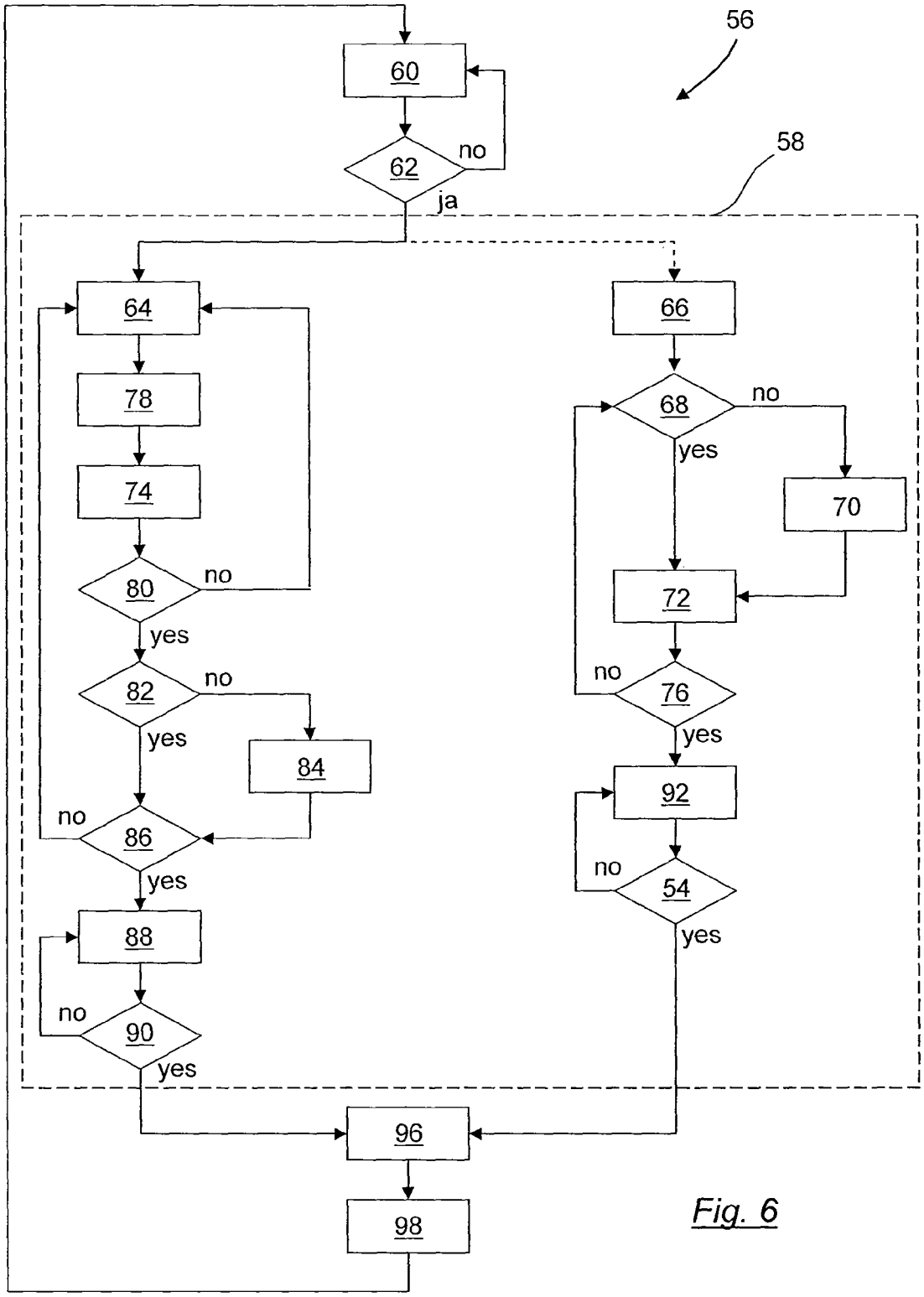
FIG. 6 is a diagram to illustrate the deployment method and coupling method.

FIG. 6 shows a deployment method 56 of the autonomous underwater vehicle 4 according to an exemplary embodiment of the invention. This deployment method 56 includes a coupling method 58 according to the invention for coupling together the coupling head 8 with the rendezvous head 18 according to an exemplary embodiment of the invention. Both the coupling head 8 and the rendezvous head 18 are located in the water below the water surface during the coupling procedure.

In particular, as part of the rendezvous device 16 the rendezvous head 18 is arranged on the underwater vehicle 4 which is brought into the water, preferably by means of the coupling device 2 comprising the coupling head 8, where it carries out a mission according to a step 60. During this mission the underwater vehicle 4 travels autonomously, for example, along a previously programmed course and in doing so performs measurements until the end of its mission is reached. The end of the mission can be specified temporally, e.g. in accordance with a capacity of energy storage devices in the underwater vehicle 4, and stored in a memory of the rendezvous device 16 or determined during the mission. If the result of a query 62 is that the end of the mission has been reached, in a step 64 the rendezvous device 16 calculates the approach trajectory 24 from the current position of the underwater vehicle 4 to the rendezvous position 6. The rendezvous position 6 is in this case read out from a memory of the rendezvous device 16, or determined, if sensor information for the purpose is already available on the rendezvous device. The current position of the underwater vehicle 4 is, on the other hand, determined by means of various sensors themselves.

In addition, after the mission end, in a step 66 initiated either automatically or manually, the coupling head 8 is lowered or sunk into the water by means of the cable 10 in the region of this rendezvous position 6 to a depth between 10 and 20 meters below the water surface. In particular, the coupling head 8 adopts a position above the rendezvous position—or a position at an equal level with the rendezvous position if the coupling head 8 is coupled essentially at the same level as the rendezvous head 18—and subsequently holds this position or holds its position to which it was lowered and thereby defines the rendezvous position 6. For example, the rendezvous position is located in a vertical direction exactly 1 meter below the rendezvous head 18—or alternatively at the same level if the coupling takes place essentially horizontally. Absolute coordinates of this rendezvous position can change, if for example the coupling head 8 is being moved uniformly in the water, because for example the support vessel to which the cable 10 is attached is also moving in the water. The position of the coupling head 8 in the water always remains stabilized, however. In particular, the coupling device 2 stabilizes the coupling head 8 in the water automatically, wherein the coupling head 8 does not rotate, does not tilt sideways, does not unintentionally drift off sideways and preferably also, the water depth at which it is arranged does not change.

To achieve this, sensors detect the current position of the coupling head 8 and/or minor positional changes of the coupling head 8. From the detected position or from the detected positional changes, control data are then calculated which control the drives 14 of the coupling head 8 such that these drives 14 counteract a change of position of the coupling head 8. Due to this, the coupling head 8 experiences no more than minor positional changes which are immediately compensated after they have been detected however, so that the coupling head 8 remains stabilized in its position. Therefore, in a step 68, a query is made as to whether the current position of the coupling head 8 corresponds to a desired position or whether the current position of the coupling head 8 lies above—or at the same level as—the position which is the desired rendezvous position 6. In the event of a deviation of position, according to a step 70 a position correction is carried out, so that the position of the coupling head 8 in the water remains stabilized.

Between the coupling head 8 and the rendezvous head 18 a signal exchange takes place over the communication channel 20. In particular, in a step 72 the rendezvous device 16 transmits acoustic signals which are received in a step 74 carried out in parallel by the coupling device 2. Conversely in this step 74, acoustic signals are also sent by the coupling device 2 via the communication channel 20 and received by the rendezvous device 16 in step 72. By means of this signal exchange, the coupling device 2 and the rendezvous device 16 determine relative positions to each other. The coupling head 8 maintains its position in the water until the underwater vehicle 4 has reached the rendezvous position 6. In one query 76 therefore, positions of the coupling head 8, which are defined by means of the dedicated sensor information and from the signals received by the coupling head 8, and positions of the rendezvous head 18 relative to each other, are queried. Based on these positions it is determined whether the underwater vehicle 4 has already reached the rendezvous position 6 or not. Until reaching the rendezvous position 6 the steps 68, if appropriate 70, 72 and 76, are carried out repeatedly by means of the rendezvous device 16.

At the same time, according to a step 78 the underwater vehicle 4 approaches the rendezvous position 6. If no signals have yet been received by the coupling head 8 from which the actual rendezvous position 6 specified by the position of the coupling head 8 can be inferred, the coupling device 2 first steers the underwater vehicle 4 in the direction of a position stored in the rendezvous device 16 as a rendezvous position, or in the direction of an assumed position. As soon as more precise information about the rendezvous position 6 is available due to the signal exchange via the communication channel 20 however, the rendezvous device 16 uses this information for calculating the approach trajectory 24 in step 64.

At a distance of approx. 10 meters between the underwater vehicle 4 and the coupling head 8, the rendezvous device 16, and possibly also the coupling device 2, changes to a precision mode. In a step 80 therefore it is queried whether a distance of less than 10 meters between the underwater vehicle 4 and the coupling head 8 has been reached. As long as a distance greater than this is present, the steps 64, 78, 74 and the query 80 are carried out repeatedly. Otherwise, in a query 82 it is queried whether the rendezvous device 16 is already in the precision mode. If this is not the case, namely if this distance has just been reached, in a step 84 the system changes into the precision mode. Finally, after query 82 or after step 84 a further query 86, analogous to query 76, is made as to whether the rendezvous position has been reached.

Until the rendezvous position 6 has been reached, the steps 86, 78, 74 and queries 80, 82 and 86 are carried out repeatedly, so that if possible, new approach trajectories 24 are continually calculated and the rendezvous position 6 is reached with a direct hit. In particular, in a close region relative to the rendezvous position 6 or relative to the coupling head 8 in the precision mode, by using a plurality of, in particular all, available sensor information and taking into account any current, the underwater vehicle is maneuvered to the rendezvous position 6.

As soon as, the rendezvous position has been reached according to queries 76 and 86, the underwater vehicle 4 holds its absolute position, possibly making active use of its driving and control means or its position relative to the coupling device 2, or to the coupling head 8, or tries to hold this position. This takes place at least until it has been determined according to a query 90 that the coupling head 8 and the rendezvous head 18 are coupled to each other, or it has been determined that a coupling is not possible from the current position, which leads to the coupling maneuver being aborted.

In a step 92 a lowering or a vertical and/or horizontal relative motion of the coupling head 8 towards the rendezvous head 18 takes place until it is determined in a query 94, analogously to query 90, that the coupling head 8 and the rendezvous head 18 are coupled together. During the lowering of the coupling head according to step 92 the coupling device 2 corrects the position of the coupling head 8 if necessary, in order to counteract any lateral drifting apart of the coupling head 8 and the rendezvous head 18 relative to each other. The position correction means 30 of the coupling device 2 therefore ensure that during the lowering, the coupling head 8 is always arranged essentially vertically above the rendezvous head 18, so that the first and second part of the coupling mechanism 46, which are described in the description of FIG. 4, are moved towards each other and ultimately locked together to achieve the coupling.

Together with the mechanical coupling, an electrical connection and a signal-transmission connection is also produced between the coupling head and the rendezvous head 18, and therefore between the underwater vehicle 4 and an energy supply device connected to the cable 10, and to devices connected to the cable 10 for signal transmission, to which the underwater vehicle 4 transmits its data collected during the mission in step 60 and from which it receives new mission data. In summary therefore, supply of the underwater vehicle 4 is effected in one step 96.

Alternatively or additionally, the underwater vehicle 4 can also be lifted out of the water by means of the cable 10 and therefore recovered. The cable 10 is therefore designed to support loading by tensile forces and comprises steel and/or aramid fibers, e.g. Kevlar, in a thickness which can withstand these tensile forces. In a particular variant for recovering the underwater vehicle 4, the cable 10 is guided into the water in a so-called moon pool of a ship and the underwater vehicle 4 is lifted out of the water through the moon pool by means of the cable 10 on board the ship. The advantage of this is a high immunity to the effects of weather conditions such as heavy seas, fog or darkness on the recovery due to the moon pool. The recovery from a stretch of water covered by an ice layer is even possible by this method. For a new mission the underwater vehicle 4 is again launched by means of the cable 10, or after releasing the coupling between the coupling head 8 and the rendezvous device 16 on board the support vessel, by another method. In particular when the underwater vehicle 4 in step 96 is merely being supplied and has remained below the water surface, in order to start a new mission the release mechanism 48 is detached in a step 98 and the rendezvous head 18 together with the underwater vehicle 4 is thereby decoupled from the coupling head 8. The underwater vehicle 4 subsequently carries out a new mission according to step 60.

All features cited in the foregoing description and in the claims can be applied both individually and in any desired combination with each other. The disclosure of the invention is therefore not restricted to the feature combinations described or claimed. Rather, all feature combinations are to be regarded as being disclosed.

What is claimed is:

1. A rendezvous device comprising:

a coupling head for coupling to a rendezvous head, wherein the coupling head comprises position stabilizing means for stabilizing its alignment and position in the water below the water surface, wherein the rendezvous head is either connectable to an underwater vehicle or is part of an underwater vehicle;

an underwater modem including a receiving device for signals or data sent by the coupling head;

a calculating device for calculating the direction and/or distance from the rendezvous head to the coupling head and a rendezvous position; and a control device configured for calculating an approach trajectory for driving the underwater vehicle in the direction of the rendezvous position according to the calculated direction and/or distance from the rendezvous head to the coupling head and for steering the underwater vehicle along the approach trajectory to the rendezvous position.

2. The rendezvous device according to claim 1, further comprising:

an imaging system for detecting the position of the coupling head relative to the rendezvous head in the vicinity of the coupling head and for transferring the detected position to the control device.

3. The rendezvous device according to claim 2, wherein the imaging system is a camera system.

4. The rendezvous device according to claim 2, wherein the imaging system is a sonar system.

5. The rendezvous device according to claim 2, wherein the imaging system is configured for detecting the position of the coupling head relative to the rendezvous head when the distance from the rendezvous head or the underwater vehicle to the coupling head is less than 10 m.

6. The rendezvous device according to claim 1, wherein the position stabilizing means comprises at least one controllable drive for actively aligning and positioning the coupling head in the water.

7. The rendezvous device according to claim 1, wherein said rendezvous device further comprises:

a first part of a two-part coupling mechanism for coupling together the rendezvous head comprising the second part to the coupling head with a force fit and/or a positive fit;

a first part of a two-part release mechanism for decoupling the rendezvous head comprising the second part from the coupling head;

an energy transmission interface detachably connectable to the rendezvous head; and a data transmission interface which can be detachably connected to the rendezvous head.

8. The rendezvous device according to claim 7, wherein electrical energy is transmitted to the underwater vehicle through the energy transmission interface when the coupling head and the rendezvous device are connected.

9. (New The rendezvous device according to claim 7, further comprising:

a second part of a two-part coupling mechanism for coupling together the rendezvous head to the coupling head comprising the first part with a force fit and/or positive fit; and a second part of a two-part release mechanism for decoupling the rendezvous head from the coupling head comprising the first part.

10. The rendezvous device according to claim 1, further comprising:

a communication device for sending signals which can be used as a positioning aid for the guided approach of the rendezvous head to the coupling head;

a position detection means for detecting the relative alignment or position of the rendezvous head relative to the coupling head; and position correction means for correcting the alignment or position of the coupling head in the water relative to the detected relative alignment or position of the rendezvous head.

11. The rendezvous device according to claim 10, wherein said communication comprises an acoustic, optical or electromagnetic communication device.

12. A coupling system comprising:

an underwater vehicle;

a rendezvous head that is connected to or part of said under water vehicle; and the rendezvous device according to claim 1.

13. A method for coupling together a coupling head and a rendezvous head of an underwater vehicle, wherein the coupling head and the rendezvous head are elements of a rendezvous device, the rendezvous device stabilizes the coupling head while underwater in for alignment and in position, the rendezvous device couples the coupling head and the rendezvous head of the underwater vehicle, and the rendezvous device is provided with a control device, an underwater modem including a receiving device, and a calculating device, the method comprising the steps of:

sending signals or data from the coupling head to the receiving device;

receiving by means of the receiving device signals or data sent by the coupling head;

calculating by means of the calculating device, the direction and/or distance from the rendezvous head to the coupling head and a rendezvous position; and calculating by means of the control device an approach trajectory for driving the underwater vehicle in the direction of the rendezvous position according to the calculated direction and/or distance from the rendezvous head to the coupling head and steering the underwater vehicle along the approach trajectory to the rendezvous position.

14. The coupling method according to claim 13, further comprising the step of:

actively aligning and positioning the coupling head in the water by means of a controlled drive.

15. The coupling method according to claim 13, wherein said rendezvous device further comprises a release mechanism, said coupling head has an energy transmission interface and a data transmission interface, and wherein in said method to perform the coupling, the coupling head is coupled to the rendezvous head by means of a coupling mechanism using a force fit and/or positive fit, whereby the energy transmission interface and the data transmission interface are detachably connected to the rendezvous head, and wherein in said method, said coupling head and said rendezvous head are adapted to be capable of being decoupled, and to perform the decoupling, the coupling head is decoupled from the rendezvous head by means of the release mechanism, whereby the energy transmission interface of the coupling head and the data transmission interface of the coupling head are each detached from the rendezvous head, and supplying electrical energy to the coupling head via an electrical supply lead of a cable mechanically connected to the coupling head and wherein the cable has a a signal or data lead so that signals or data can be transferred to and/or from the coupling head via the cable.

16. The coupling method according to claim 13, wherein the coupling head further comprises a communication device whereby the coupling head communicates with the rendezvous device, the coupling head transmits signals which the rendezvous device receives and uses as a positioning aid for positioning the rendezvous head relative to the coupling head and/or for calculating an approach trajectory for driving the underwater vehicle in the direction of a rendezvous position for coupling the rendezvous head with the coupling head and, the coupling head includes position detection means, wherein by means of the underwater vehicle controlled by these signals the rendezvous head approaches the rendezvous position, the rendezvous device includes means for correcting the position of the underwater vehicle and/or said coupling head, and said method further comprises the coupling head detecting the alignment or position of the rendezvous head and/or of the underwater vehicle relative to the coupling head and any transverse displacement of the rendezvous head from this alignment or position relative to the approach trajectory by means of the position detection means of the coupling head, and correcting for detected transverse displacement regarding the alignment or position of the coupling head and the rendezvous head according to a detected alignment or position, to a detected transverse displacement of the rendezvous head and/or to the underwater vehicle by means of the position correction means.

* * * * *